US005425912A

United States Patent [19]

Smith et al.

[11] Patent Number: 5,425,912

[45] Date of Patent: Jun. 20, 1995

[54] LOW EXPANSION SUPERALLOY WITH IMPROVED TOUGHNESS

[75] Inventors: Darrell F. Smith; Larry I. Stein, both of Huntington, W. Va.; Il S. Hwang, Seoul, Rep. of Korea

[73] Assignees: Inco Alloys International, Inc., Huntington, W. Va.; Massachusetts Institute Of Technology, Cambridge, Mass.

[21] Appl. No.: 271,842

[22] Filed: Jul. 7, 1994

[51] Int. Cl.[6] ..... C22C 19/05; C22C 30/00

[52] U.S. Cl. ..... 420/447; 420/586; 420/584.1

[58] Field of Search ..... 420/95, 447, 448, 454, 420/56, 97, 586, 584.1

[56] References Cited

U.S. PATENT DOCUMENTS

| | | | |
|---|---|---|---|
| 3,971,677 | 7/1976 | Mason et al. | 420/95 |
| 4,066,447 | 1/1978 | Smith, Jr. et al. | 75/122 |
| 4,144,102 | 3/1979 | Smith, Jr. et al. | 188/2 |
| 4,785,142 | 11/1988 | Smith, Jr. et al. | 174/15 |
| 5,304,346 | 4/1994 | O'Donnell et al. | 420/94 |

*Primary Examiner*—Deborah Yee
*Attorney, Agent, or Firm*—Edward A. Steen

[57] ABSTRACT

A high strength, low coefficient of thermal expansion superalloy exhibiting improved toughness over a broad temperature range down to about 4° K. The composition is adapted for use with wrought superconducting sheathing.

7 Claims, No Drawings

LOW EXPANSION SUPERALLOY WITH IMPROVED TOUGHNESS

This invention was made with government support under contract number DE-AC02-7BET-51013 awarded by the Department of Energy. The government has certain rights in the invention.

TECHNICAL FIELD

This invention relates to superalloys in general and, more particularly to a low coefficient of thermal expansion ("CTE") superalloy adapted for superconductor sheathing applications,

BACKGROUND ART

U.S. Pat. Nos. 4,066,447 and 4,144,102 disclose a low CTE material commercially available as Incoloy® alloy 908. (Incoloy is a trademark of the Into family of companies). The alloy includes about 4% chromium, about 3% niobium, about 1.5% titanium, about 1% aluminum, about 49% nickel, and the balance iron. Cobalt is an optional element ranging from 0 to about 31%. Cobalt containing versions are usually destined for aerospace applications—turbine gas seals and rings. Cobalt-free (or low level variations) exhibit satisfactory CTE values. However, they are employed in situations where cobalt containing materials are undesirable such as in neutron flux environments.

U.S. Pat. No. 4,785,142, which utilizes a cobalt-free version of Incoloy alloy 908, discloses a superconducting cable sheath including about 46–50% nickel, about 3–6% chromium, about 2.5–3.5% niobium, about 1.25%-1.65% titanium, about 0.8–1.2% aluminum, and the balance iron.

Alloys described in the referenced prior art patents are well suited for wrought alloy applications required for superconductor sheathing in the form of seamless tubes or thin-walled autogenous welded tubes. However, these alloys display Nb rich, Laves-type phases that segregate upon solidification during welding. Such phases lead to undesirable reduced ductility and toughness in the weldments. There exists a need for weldments with improved toughness in these applications. The improvement in toughness, however, must be realized with a minimum sacrifice of alloy strength.

SUMMARY OF THE INVENTION

Accordingly, there is provided a low CTE alloy that demonstrates a good combination of strength and toughness in weldments over a broad temperature range down to 4° K.

The instant alloy encompass about 35–55% nickel, about 0–6% chromium, about 1.2–2.25% titanium, about 0–25% cobalt, about 0.25–1.25% niobium, about 0.5–1.5% aluminum, about 40–60% nickel plus cobalt, up to about 3% molybdenum, up to about 0.2% carbon, up to about 2% manganese, up to about 1% silicon, up to about 0.03 % boron, and the balance iron.

PREFERRED MODE FOR CARRYING OUT THE INVENTION

Incoloy alloy 908 is a candidate conduit material for the large-scale $Nb_3Sn$ superconducting magnets of the International Thermonuclear Experimental Reactor (ITER). It is a nickel-iron base precipitation-hardening superalloy with a chemical composition that has been optimized for a low coefficient of thermal expansion, superior cryogenic structural properties, and phase stability during the $Nb_3Sn$ reaction heat treatment. The alloy precipitates $\gamma''$, $Ni_3$ (Al, Ti, Nb), as the primary strengthening phase and has demonstrated excellent mechanical properties at both 298° and 4° K. However, welds of the alloy have shown reduced fracture toughness. Since fabrication of the cable-in-conduit conductors for ITER will require welding, the basis of the instant alloy has been to improve fracture toughness while maintaining adequate weld strength.

In order to optimize the desired properties, a number of ingots were produced. The ingots were homogenized at 1190° C. for 16 hours and fast cooled. A series of forging and reheating steps reduced ingots into 7 mm thick plates. Weld filler metals were prepared as rods 300 mm long×16 mm diameter. The rods were cold drawn into 1.6 mm diameter wires with intermediate anneals at 1040° C. after every reduction.

Table 1 lists the compositions of the various weld filler metal ingots. An embodiment of Incoloy alloy 908 is identified first for comparison purposes. The composition of the instant filler metals were based on alloy 908 chemistry, but with alteration of the amount of precipitation hardening elements (Nb, Al, and Ti). Since the low thermal expansion characteristics depend strongly on the chromium content in the $\gamma$ matrix, chromium content was maintained at 4 wt. % in all materials. Of the three major hardening elements, niobium is the most likely to segregate during solidification in some nickel base superalloys. It is well understood that the microsegregation of niobium in the weld of Nb-rich superalloys, such as Inconel® alloy 718 and some 900-series Incoloy alloys, results in the formation of Laves phases. (Inconel is a trademark of the Into family of companies). Furthermore, preliminary studies showed that niobium-rich Laves phases, $(Fe, Ni)_2$ (Nb, Ti) were formed during weld solidification and served as void initiation sites during fracture. For this reason a focus was made on reducing the niobium concentration. To compensate for loss of strength due to reduced niobium, the titanium and aluminum levels were increased in some of the filler metals. Molybdenum was also added to two compositions to promote solid solution hardening. Carbon and silicon were intentionally minimized.

TABLE 1

| | All compositions in Weight Percent | | | | | | | | |
|---|---|---|---|---|---|---|---|---|---|
| Filler Metal | Fe | Ni | Cr | Nb | Al | Ti | Mo | Si | C |
| 908 | 41.5 | 49 | 4 | 3 | 1 | 1.5 | — | <0.3 | <0.03 |
| FA | 40.1 | 50.1 | 4.01 | 3.04 | 1.08 | 1.83 | 0.006 | <0.001 | <0.001 |
| FC | 41.7 | 50.2 | 4.03 | 0.99 | 1.00 | 1.84 | 0.009 | <0.001 | <0.001 |
| GA | 41.4 | 50.2 | 4.02 | 1.51 | 1.12 | 1.85 | 0.004 | <0.001 | <0.001 |
| GB | 41.0 | 50.3 | 4.03 | 1.50 | 1.07 | 2.32 | 0.005 | <0.001 | <0.001 |
| GC | 40.9 | 50.3 | 4.03 | 1.52 | 1.54 | 1.84 | 0.005 | <0.001 | <0.001 |
| GD | 40.5 | 50.3 | 4.00 | 1.48 | 1.59 | 2.31 | 0.002 | <0.001 | <0.001 |
| HA | 41.7 | 51.2 | 4.07 | 0.52 | 1.09 | 1.85 | 0.002 | <0.001 | <0.001 |
| HB | 44.6 | 49.7 | 4.03 | 0.50 | 0.55 | 0.57 | 0.002 | <0.001 | <0.001 |

TABLE 1-continued

| Filler Metal | Fe | Ni | Cr | Nb | Al | Ti | Mo | Si | C |
|---|---|---|---|---|---|---|---|---|---|
| | All compositions in Weight Percent | | | | | | | | |
| HC | 40.7 | 50.0 | 4.01 | 0.51 | 1.05 | 1.84 | 1.950 | <0.001 | <0.001 |
| HD | 42.9 | 49.4 | 3.99 | 0.50 | 0.57 | 0.58 | 1.970 | <0.001 | <0.001 |

Samples for the welding program were fabricated from the 7 mm thick plates described above. The weld geometry for multipass gas tungsten are welding (GTAW) was a 90° included angle V-groove design with a 300 mm length. Welds were made manually, using the appropriate filler wire, with 2%-thoriated tungsten electrodes at a speed of 100–150 mm per minute. Conditions were DC straight polarity and argon shielding at 12–14 V and 140–180 A. Five to six passes were required to complete welding.

Plates for electron beam welding (EBW) and laser beam welding (LBW) were carefully machined with square ends to provide good face contact. EBW was done in vacuum at a speed of 25 mm/sec with a power of 3.6 kW. LBW was done in an argon gas environment at a speed of 17 mm/sec with a power of 5 kW.

Flash butt welding (FW) was done in both atmospheric and argon gas environments with plates having 7 mm×25 mm cross section. The plates, initially separated by 55 mm, were flashed over 20 mm at an acceleration of 0.05 mm/sec$^2$, and then were welded by upsetting over a 8 mm distance in 0.25 sec using 50 kN force.

Welded samples were then heat treated at 650° C./200 hr in vacuum to simulate a possible superconductor reaction heat treatment. Some of the EBW and GTA welded samples were annealed before machining and aging. Two known postweld heat treatment conditions were selected for thermomechanical processing. A 980° C./1 hr heat treatment is widely used as a mill anneal. A 1050° C./1 hr heat treatment is used to solutionize secondary phases, such as Laves phases in welds. Samples were water-quenched after annealing treatments to suppress precipitation of hardening phases.

Selected weld samples were cold rolled by about 9% to simulate the deformation that will be experienced during the conduit manufacturing process. For these materials, mechanical properties were investigated at 4° K. as well as 298° K.

Specimens were machined out of welded plates keeping the weld in the middle. Mechanical testing procedures are in accordance with ASTM methods including E-8 (tension testing), E-399 (plane-strain fracture toughness testing), E-813 (J-integral testing), and E-1152 (J-R curve determination).

The results of 298° K. tensile tests and fracture toughness tests of various welds are summarized in Tables 2 and 3. Tensile properties of GTA welds are a function of the amount of hardening elements present in the filler wires. GTA welds with molybdenum and reduced-niobium content (HC-GTAW and HD-GTAW) showed no significant changes in tensile properties at 298° K. over that of Incoloy alloy 908 base metal. Postweld annealing of EBW samples resulted in greatly reduced yield strength ($\sigma_y$) and ultimate tensile strength (UTS) in welds. Of the two annealing conditions, 980° C./1 hr annealing showed less loss of weld strength than 1050° C./1 hr annealing. EBW and LBW samples showed slightly lower yield strengths and higher ultimate tensile strengths when compared to GTA welds made with alloy 908 filler wire. Cold work resulted in an increased yield strength with only moderate changes in ultimate tensile strength for HA- HB-, and HD-GTWA at 298° K.

TABLE 2

Tensile and fracture toughness results of various welds at 298K (aged 200 hr at 650° C.)

| | Cold work, % | $\sigma_y$, MPa | UTS, MPa | $K_{IC}$, MPa$\sqrt{m}$ |
|---|---|---|---|---|
| 908 Base | — | 1075 | 1433 | 196 ± 5 |
| 908 Base | 20 | 1279 | 1499 | — |
| 908-GTAW | — | 1062 | 1316 | 106 ± 8 |
| EBW | — | 1011 | 1376 | 126± |
| LBW | — | 1049 | 1358 | 120 ± 5 |
| FW in air | — | 1059 | 1402 | 86 |
| FW in air | — | 1095 | 1429 | 78 |
| FA-GTAW | — | 1079 | 1347 | 109.5 |
| FC-GTAW | — | 965 | 1249 | 136 ± 17 |
| GA-GTAW | — | 1001 | 1298 | 133 ± 8 |
| GB-GTAW | — | 1035 | 1307 | 123 ± 11 |
| GC-GTAW | — | 1021 | 1276 | 127 ± 13 |
| GD-GTAW | — | 1058 | 1333 | 102 ± 10 |
| HA-GTAW | — | 973 | 1247 | 168 ± 9 |
| HA-GTAW | 9 | 1126 | 1307 | 168 |
| HB-GTAW | — | 845 | 1117 | 185 ± 13 |
| HB-GTAW | 9 | 968 | 1147 | 173 ± 5 |
| HC-GTAW | — | 982 | 1283 | 144 ± 16 |
| HD-GTAW | — | 796 | 1130 | 157 ± 17 |
| HD-GTAW | 9 | 896 | 1159 | — |
| EBW + 1050 C/hr | — | 850 | 1191 | 342 ± 1* |
| EBW + 980 C/1 hr | — | 918 | 1307 | 259 ± 11* |

*Violated the thickness requirements for valid $K_{IC}$

TABLE 3

Tensile and fracture toughness results of various welds at 4°K (aged 200 hr at 650° C.)

| Specimens | Cold work, % | $\sigma_y$, MPA | UTS, MPa | $K_{IC}$, MPa$\sqrt{m}$ |
|---|---|---|---|---|
| 908 Base | — | 1227 | 1892 | 235 ± 5 |
| 908 Base | 20 | 1489 | 1903 | — |
| 08-GTAW | — | 1279 | 1648 | 105 ± 1 |
| HA-GTAW | — | 1074 | 1538 | 150 |
| HA-GTAW | 9 | 1265 | 1690 | 130 ± 10 |
| HB-GTAW | — | 1001 | 1522 | 214 |
| HB-GTAW | 9 | 1072 | 1505 | 161 |
| HA-GTAW | — | 1074 | 1538 | 150 |

The effect of cold work is greater in HA-GTAW than in HB-GTAW at 4° K. The fracture toughness ($K_{1C}$) of GTA welds with the new filler metals lies within the range of 100 to 185 MPa$\sqrt{m}$ at 298° K. GTA welds HA and HB showed high $K_{1C}$ at 298° K. and were selected for further tests to verify the effects of cold work and test temperature.

The addition of 9% cold work in samples HA-GTAW and HB-GTAW caused no significant change in fracture toughness at 298° K. At 4° K., the toughness of HA-GTAW decreased significantly. However, that of sample HB-GTAW increased slightly. Cold work lowered the toughness of these welds at 4° K.

EBW and LBW welds had slightly higher $K_{1C}$ than 908-GTA welds at 298° K. Flash welds in both air and argon showed reduced $K_{1C}$ values. Welds with reduced niobium concentration filler wires showed lower growth rates than 908-GTAW over the K ranges tested.

At 298° K., GTA welds made with alloy 908 filler wire exhibited lower crack growth rates, over the tested K ranges, than alloy 908 base metal.

The microstructure of a low fracture toughness weld (FA-GTAW) and a high fracture toughness weld (HA-GTAW) were compared. A cellular dendritic structure was apparent in both. EBW and LBW samples, which experienced higher cooling rates, showed a similar microstructure but with a smaller dendritic arm spacing. About a two-fold difference in dendritic spacing was observed with the range of fusion welding methods. With LBW, micropores as big as a few hundred microns in diameter were observed and it is hypothesized that argon shielding gas was trapped.

The chemical compositions of carbide and Laves phases found in various welds are summarized in Table 4. SEM analysis of the precipitates within the interdendritic areas revealed that their compositions were very close to those of either niobium-rich MC carbides or Laves phases. Niobium and titanium are partitioned into MC carbides. In flash-welded specimens, only MC carbides were detected along the upset flow lines. Considering the characteristics of flash welding in which the molten metal is expelled at the time of joining, the absence of Laves phases is understandable.

TABLE 4

Chemical Compositions of Extracted Phases in alloy 908 welds (in weight percent)

| | | Fe | Ni | Cr | Nb | Al | Ti | Si |
|---|---|---|---|---|---|---|---|---|
| 908-GTAW | MC | 0.83 | 0.89 | 0.10 | 75.5 | 0.64 | 22.1 | — |
| | Laves | 23.7 | 34.3 | 1.43 | 32.5 | 0.93 | 3.39 | 3.70 |
| EBW | MC | 4.59 | 15.8 | 0.64 | 69.9 | — | 9.68 | — |
| | Laves | 9.35 | 33.0 | 2.25 | 28.1 | — | 1.84 | 4.39 |
| FW | MC | 6.14 | 5.97 | 9.63 | 55.3 | — | 2.00 | — |
| 908-GTAW + 1050° C. 1 HR | MC | — | 2.71 | — | 58.7 | — | 8.6 | — |

Microstructures of 1050° C./1 hr annealed 908-GTAW and EBW showed only fine carbide particles dispersed within the welds. X-ray diffraction analysis on extracted particles from 908-GTAW and 908-GTAW+1050° C./1 hr confirmed these findings.

Strength and fracture toughness of four welds were compared to alloy 908 base metal. Only cold worked HA-GTAW lies within a 1200 MPa–120 MPa $\sqrt{m}$ box at 4° K. The other cold worked weld, HB-GTAW, showed higher fracture toughness but with much lower yield strength at 4° K. Based on this study, alloy HA filler wire is considered the best candidate for ITER conductor conduits.

In summary:

1. Two welds, HA-GTAW and HB-GTAW show most improved mechanical properties over 908-GTAW at 298° K. The 4° K. fracture toughness in a cold worked condition if these two welds are over 120 MPa $\sqrt{m}$. Of the two, HA-GTAW with cold work has higher yield strength and fatigue crack resistance than HB-GTAW with cold work.
2. A reduction of niobium concentration in filler metals improved fracture toughness of welds. In particular, by reducing niobium from 3 to 0.5%, fracture toughness was increased by approximately 50% with relatively small loss of strength (−10% drop in yield strength) at 298° K.
3. The use of EBW and LBW techniques, which refine the weld microstructure, are not effective in improving fracture toughness.
4. Flash butt welding shows relatively low toughness compared to GTAW. Fracture occurred along bond lines with little resistance, producing fracture surfaces covered with fine dimples.
5. Post-weld annealing recovered fracture toughness at 298° K. A 1050° C./1 hr anneal on 908-GTAW removed brittle secondary phases completely.
6. For the tested welds, as temperature changes from 298° K. to 4° K., yield strength increases by more than 100 MPa, while fracture toughness decreases slightly except HB-GTAW.
7. In addition to the ranges identified above, a further preferred range for the instant alloy is: about 45–55% nickel, about 0.3–0.7% niobium, about 0.8–1.2% aluminum, about 3.5% chromium, about 1.4–2.0% titanium, the usual commercial impurities, and balance iron.

While in accordance with the provisions of the statute, there are illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A low coefficient of expansion superalloy exhibiting high strength and toughness consisting essentially of about 45–55% nickel, about 3–6% chromium, about 1.2–2.1% titanium, about 0–25% cobalt, about 0.25–1.25% niobium, about 0.5–1.5% aluminum, about 0–3% molybdenum, less than about 0.001% carbon, about 0–2% manganese, about 0–1% silicon, about 0–0.03 % boron, about 45–60% nickel and cobalt, trace impurities, and the balance iron.

2. The superalloy according to claim 1 including about 45–55% nickel, about 0.3–0.7% niobium, about 0.8–1.2% aluminum, about 3–5% chromium, and about 1.4–2.0% titanium.

3. The superalloy according to claim 1 including about 41.7% iron, about 51.2% nickel, about 4.07% chromium, about 0.52% niobium, about 1.09% aluminum, and about 1.85% titanium.

4. The superalloy according to claim 1 in the form of a filler metal.

5. The superalloy according to claim 1 affixed to a superconductor sheath.

6. The superalloy according to claim 1 included in a weldment.

7. The superalloy according to claim 1 exhibiting a 4° K. fracture toughness of at least about 120 MPa $\sqrt{m}$.

* * * * *